US008672244B2

(12) United States Patent
Wildfang

(10) Patent No.: US 8,672,244 B2
(45) Date of Patent: Mar. 18, 2014

(54) JET FORMER

(75) Inventor: Fabian Wildfang, Badenweiler (DE)

(73) Assignee: Neoperl GmbH, Müllheim (DE)

( * ) Notice: Subject to any disclaimer, the term of this patent is extended or adjusted under 35 U.S.C. 154(b) by 768 days.

(21) Appl. No.: 12/447,672

(22) PCT Filed: Oct. 26, 2007

(86) PCT No.: PCT/EP2007/009288
§ 371 (c)(1),
(2), (4) Date: Apr. 29, 2009

(87) PCT Pub. No.: WO2008/071256
PCT Pub. Date: Jun. 19, 2008

(65) Prior Publication Data

US 2010/0072305 A1 Mar. 25, 2010

(30) Foreign Application Priority Data

Dec. 15, 2006 (DE) ..... 10 2006 059 808

(51) Int. Cl.
*B05B 1/04* (2006.01)

(52) U.S. Cl.
USPC ..... 239/594; 239/592

(58) Field of Classification Search
USPC ..... 239/589, 590.3, 592, 596, 600, 593, 239/594
See application file for complete search history.

(56) References Cited

U.S. PATENT DOCUMENTS

| | | | | |
|---|---|---|---|---|
| 1,721,945 | A * | 7/1929 | Cornelius | 239/559 |
| 6,241,166 | B1 * | 6/2001 | Overington et al. | 239/553.3 |
| 6,739,527 | B1 * | 5/2004 | Chung | 239/558 |
| 7,093,780 | B1 * | 8/2006 | Chung | 239/587.1 |
| 2005/0086733 | A1 | 4/2005 | Li et al. | |

FOREIGN PATENT DOCUMENTS

| | | |
|---|---|---|
| DE | 20317910 | 3/2004 |
| DE | 20304656 | 9/2004 |
| DE | 10354150 | 3/2005 |
| FR | 1296058 | 6/1963 |
| WO | 9816694 | 4/1998 |
| WO | 2004083537 | 9/2004 |

* cited by examiner

*Primary Examiner* — Davis Hwu
(74) *Attorney, Agent, or Firm* — Volpe and Koenig, P.C.

(57) ABSTRACT

A jet former (1), which can be fitted into the water outlet (2) of a sanitary outlet fitting and has at least one homogenizing device (3) with a multiplicity of throughflow holes (4), which are respectively enclosed by flow guiding walls (5). The jet former (1) has a greater jet width (1) in comparison with the jet depth (t) to create a flat water jet, by a flow guide (6) that tapers in a nozzle-like manner, at least in a partial region in the direction of throughflow, being arranged upstream or downstream of the at least one homogenizing device (3) and by the flow guide (6) having on both sides of its longitudinal extent edge regions (7, 8) with a greater throughflow cross section in comparison with the longitudinal center region (9). While a smooth, homogenized jet with a transparent, clear jet pattern can be formed with the aid of the homogenizing device (3) and its throughflow holes (4) enclosed by flow guiding walls (5), this jet can be continued as a clearly contoured, flat water jet over a comparatively long free distance by the flow guide (6).

8 Claims, 4 Drawing Sheets

JET FORMER

BACKGROUND

The invention refers to a jet former which is arranged in the water outlet of a sanitary outlet fitting and which has at least one homogenizing device with a multiplicity of throughflow holes which are delimited in each case by flow-guiding walls.

A jet former, which is designed as a jet regulator, in most cases is fitted into the water outlet of conventional sanitary outlet fittings and is to form the inflowing water flow into a homogeneous and non-spraying water jet. The previously known jet regulators have a homogenizing device for this, which has a honeycomb-like structure or even a grid-like or net-like structure with a multiplicity of throughflow holes which are delimited in each case by flow-guiding walls. In this case, additional functional units can be connected upstream to the homogenizing device on the inflow side, if necessary.

The previously known jet regulators in most cases have a round throughflow cross section which is adapted to the outlet fitting. Efforts are increasingly being made, however, to also design such outlet fittings in an aesthetically sophisticated and unique manner. Therefore, outlet fittings have already also been created which have a water outlet which has a greater clear throughflow width in comparison to the depth. The water jet which flows out of such an outlet fitting, however, in most cases only has the aimed-for form of a water jet band at the beginning before the water jet, after a comparatively short free distance, is already constricted into an erratic and uncontrolled non-round jet form.

SUMMARY

Therefore, the object is especially to create a jet former of the type mentioned in the introduction, which is characterized by a flat homogeneous water jet, wherein the water jet is to appear transparent over a comparatively long free distance and is to have no turbulences which influence the transparency of the water jet.

The achieving of this object according to the invention, with the jet former of the type mentioned in the introduction, consists especially in the fact that the jet former has a greater jet width in comparison to the jet depth for creating a flat water jet band, in the fact that a flow guide, which tapers in a nozzle-like manner in the throughflow direction at least in one section, is connected upstream or downstream of the at least one homogenizing device, and in the fact that the flow guide on both sides of its longitudinal extent has edge regions with a larger throughflow cross section in comparison to the longitudinal middle region.

The jet former according to the invention, over and above additional functional units, has a homogenizing device if required, which by means of its throughflow holes, which are delimited by flow guiding walls, forms a smooth, evened-out jet with a transparent, clear jet pattern. In order to be able to continue this jet as a clearly contoured, flat water jet band over a comparatively long free distance, a flow guide, which tapers in a nozzle-like manner in the throughflow direction at least in one section, is connected upstream or downstream to the homogenizing device. This flow guide on both sides of its longitudinal extent has edge regions with a larger throughflow cross section in comparison to the longitudinal middle region. In the edge-side corner regions, a directed jet of greater volume is created in each case, wherein these directed jets, which are arranged in the corner regions, are interconnected by a central jet film. By means of the jet former according to the invention, an inhomogeneous water distribution, with edge definition of greater of lesser degree, is achieved over the jet cross section, wherein the edge definition can be varied if necessary by the configuration of the flow guide and its clear cross section.

In order to create directed jets of sufficiently large volume in the corner regions, which can maintain a clear, smooth water jet band even over a comparatively long distance, it is expedient if the flow guide has a bone-shaped, clear cross-sectional contour on the outlet side.

A preferred embodiment according to the invention makes provision for a water jet band to be produced in the flow guide, which on both sides in the edge regions has in each case a jet region with increased volumetric flow in comparison to the longitudinal middle region, and between these jet regions has a water film which interconnects them.

The producibility of the jet former according to the invention is simplified more if the jet former can be detachably fitted into the water fitting and retained there preferably in a frictionally engaged manner.

In order to benefit the high-quality jet pattern of the jet former according to the invention, and so as not to impair its jet pattern by laminar flows which flow through undesirable gaps, it is advantageous if the jet former on its circumferential wall carries an encompassing ring seal which is preferably retained in an external groove of the circumferential wall of the jet former.

The simple producibility of the jet former according to the invention benefits, and a modular construction of this jet former can be advantageously achieved, if the homogenizing device can be detachably fitted into the jet former.

An especially advantageous development according to the invention makes provision for the flow guiding walls of the homogenizing device to form a grid-like or net-like structure, or a honeycomb-like structure.

Developments according to the inventions result from the available description in conjunction with the claims. The invention is subsequently explained in even more detail based on advantageous exemplary embodiments.

DETAILED DESCRIPTION OF THE PREFERRED EMBODIMENTS

Figure 1:
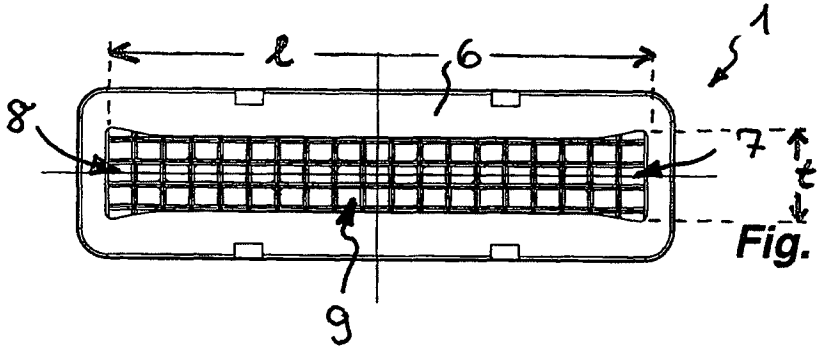
FIG. 1 shows a jet former in a plan view of its outlet side.
Figure 2:
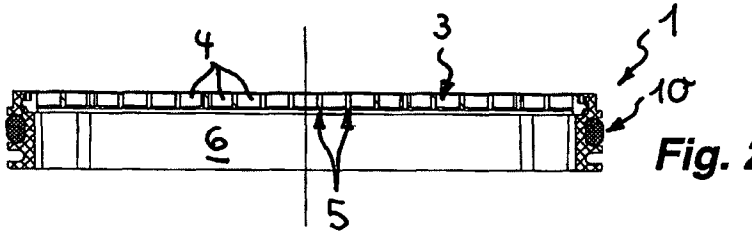
FIG. 2 shows the jet former from FIG. 1 in a longitudinal section in the sectional plane III-III according to FIG. 3.
Figure 3:
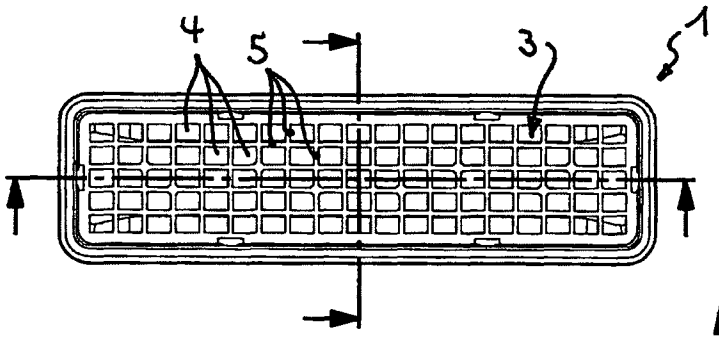
FIG. 3 shows the jet former from FIGS. 1 and 2 in a plan view of its inflow side.
Figure 4:
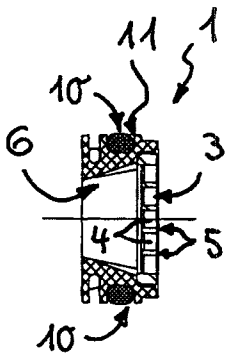
FIG. 4 shows the jet former from FIGS. 1 to 3 in a cross section in the sectional plane IV-IV according to FIG. 3.
Figure 6:
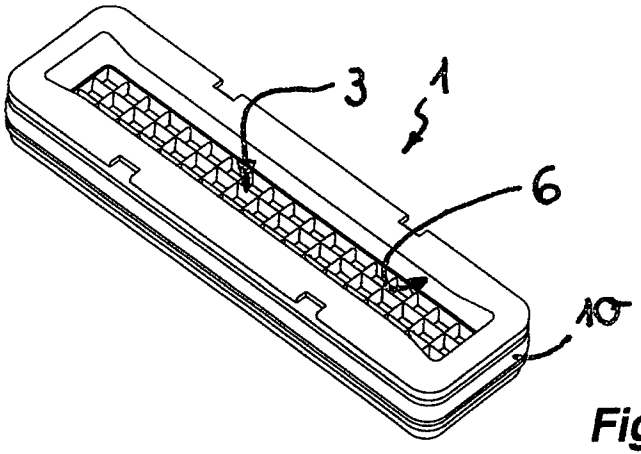
FIG. 6 shows the jet former from FIGS. 1 to 5 in a perspective plan view of its outlet side.
Figure 5:
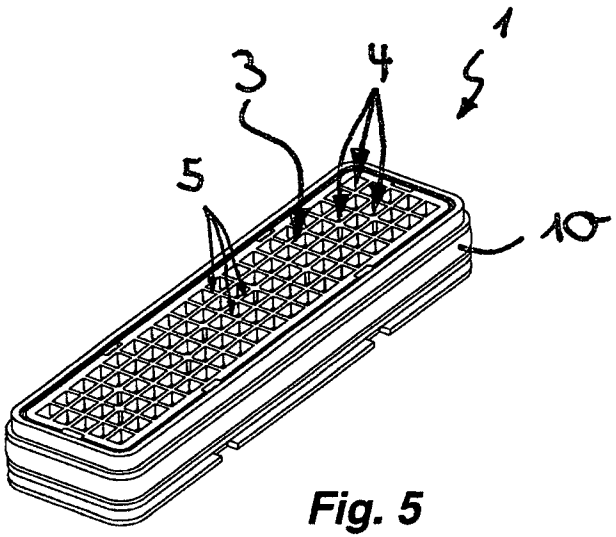
FIG. 5 shows the jet former from FIGS. 1 to 4 in a perspective view of its inflow side.

In FIGS. 1 to 7, a jet former 1 is shown in different views. From the cross section in FIG. 7, it becomes clear that the jet former 1 can be fitted into the water outlet 2 of a sanitary outlet fitting. The jet former 1 has a homogenizing device 3 which forms the inlet flow-side end face of the jet former 1. The homogenizing device 3 has a multiplicity of throughflow holes 4 which are delimited in each case by flow guiding walls 5. From FIGS. 1, 3 and 5 to 7, it becomes clear that the flow guiding walls 5 form a grid-like structure.

In FIG. 1, it is evident that the jet former 1 has a greater jet width 1 in comparison with the jet depth t for creating a flat water jet band. From the cross sections in FIGS. 4 and 7, it is evident that a flow guide 6, which tapers in a nozzle-like manner in the throughflow direction at least in one section, is connected downstream of the homogenizing device 3. This flow guide 6 on both sides of its longitudinal extent has edge regions 7, 8 with a larger throughflow cross section in comparison to the longitudinal middle region 9. The homogenizing device 3, by means of its throughflow holes 4 which are delimited by flow guiding walls 5, forms a smooth, evened-out water jet with a transparent, clear jet pattern. In order to be able to continue this jet as a clearly contoured, flat water jet band over a comparatively long free distance, a flow guide 6, which tapers in a nozzle-like manner in the throughflow direction at least in one section, is connected downstream of the homogenizing device 3. This flow guide 6 on both sides of its longitudinal extent has edge regions 7, 8 with a larger throughflow cross section in comparison to the longitudinal middle region 9. In the edge-side corner regions, a directed jet of greater volume is created in each case, wherein these directed jets, which are located in the corner regions, are interconnected by means of a center jet film. By means of the jet former 1 which is shown here, an inhomogeneous water distribution, with edge definition of greater or lesser degree, is achieved over the jet cross section, wherein the edge definition can be varied by the configuration of the flow guide 6 and of its clear cross section.

Figure 7:
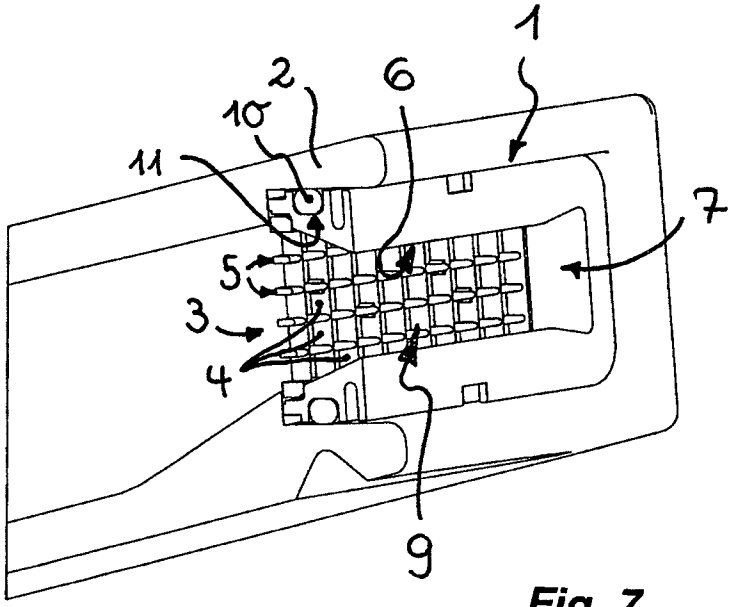
FIG. 7 shows the jet former from FIGS. 1 to 6, which is detachably retained in the water outlet of a sanitary outlet fitting, in a perspective cross section.
Figure 8:
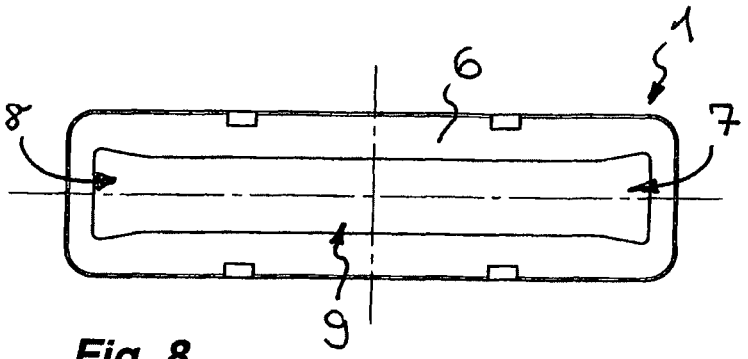
FIGS. 8 to 10 show the outlet side of different jet formers in a plan view, wherein these jet formers differ in the clear cross section of their flow guide.
Figure 9:
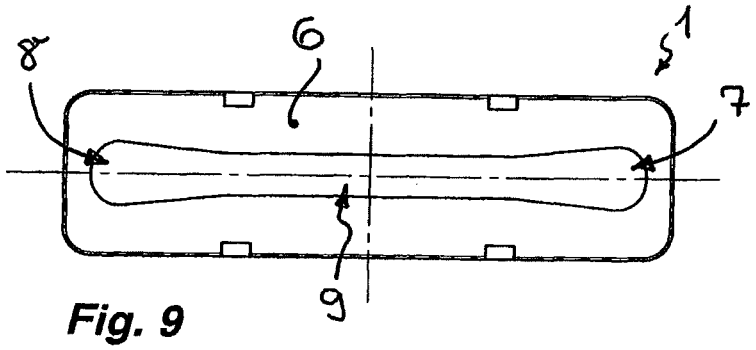
Figure 10:
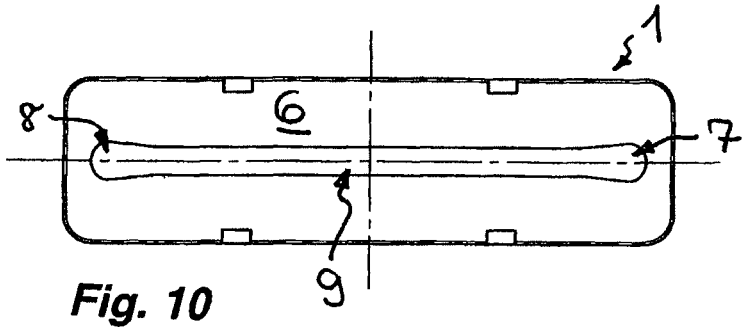

From a comparison of the outflow sides which are shown in FIGS. 1, 6 and 7 to 10, it becomes clear that the flow guide 6 has a bone-shaped, clear cross-sectional contour on the outlet side. In this case, it is shown in FIGS. 8 to 10 that as a result of the contour of the flow guide 6 the edge definition of the water jet which is created in the jet former 1 can be varied to a greater or lesser degree.

In FIG. 7, it is evident that the jet former 1 can be detachably fitted into the water outlet 2 and retained there preferably in a frictionally engaged manner. In this case, the jet former 1 on its circumferential wall carries an encompassing ring seal 10 which is preferably retained in an external groove 11 of the circumferential wall of the jet former 1.

In order to be able to inexpensively produce the jet former 1 with the least possible cost, and in order to achieve a modular construction of the jet former 1, the homogenizing device 3 can be detachably fitted into the jet former 1.

In FIGS. 1, 3 and 5 to 7, it becomes clear that the flow guiding walls 5 of the homogenizing device 3 have a grid-like structure. The jet former 1 can be inserted into the water outlet from the outlet side of a sanitary outlet fitting and also retained there in a press fit by means of the ring seal 10. In the edge regions 7, 8, two directed jets are formed, which are developed to a greater or lesser degree, between which a stable water film can then be formed. The edge-side directed jets, and the water film which is located in the longitudinal middle region 9 of the flow guide 6, can vary to a greater or lesser degree, which can be achieved as a result of the different "bone-shaped" restriction contours of the jet former 1. The homogenizing device, which is provided on the inflow side of the jet former 1, has the task of homogenizing the jet and forming a transparent jet pattern without disturbing turbulences which otherwise could unfavorably influence the transparency of the water jet. The jet former 1 efficiently counteracts a premature collapsing of the water jet which is created within it, wherein by means of the jet former 1 a smooth jet surface and a transparent, clear jet pattern can be achieved.

The invention claimed is:

1. A jet former (1), which can be fitted in the water outlet (2) of a sanitary outlet fitting, the jet former comprising at least one homogenizing device (3) with a multiplicity of throughflow holes (4) which are delimited in each case by flow-guiding walls (5), the jet former (1) in a plane defined transverse to a throughflow direction at an outlet end has a greater jet width (1) in comparison to a jet depth (t) for producing a flat water jet band, a flow guide (6), which tapers in a nozzle-like manner in a throughflow direction at least in one section, is connected upstream or downstream of the at least one homogenizing device (3), and the flow guide (6) has a greater longitudinal extent in a direction of the jet width in comparison to a depth thereof in the plane defined transverse to the throughflow direction at the outlet end, wherein on both sides of the longitudinal extent, edge regions (7, 8) of the flow guide (6) are provided with a larger throughflow cross section in the plane defined transverse to the throughflow direction in comparison to a throughflow cross-section of a longitudinal middle region (9) of the flow guide (6).

2. The jet former as claimed in claim 1, wherein the flow guide (6) has a bone-shaped, clear cross-sectional contour on an outlet side.

3. The jet former as claimed in claim 1, wherein in the flow guide (6) a water jet band can be created, which on both sides in the edge regions (7, 8) has in each case a jet region with increased volumetric flow in comparison to the longitudinal middle region (9), and between the jet regions (7, 8) is adapted to form a water film which interconnects them.

4. The jet former as claimed in claim 1, wherein the jet former (1) is detachably fitted into the water outlet (2) of the outlet fitting, and retained there in a frictionally engaged manner.

5. The jet former as claimed in claim 1, wherein the jet former (1) includes a circumferential wall which carries an encompassing ring seal (10) which is retained in an external groove (11) of the circumferential wall.

6. The jet former as claimed in claim 1, wherein the homogenizing device (3) is detachably fitted into the jet former (1).

7. The jet former as claimed in claim 1, wherein the flow guiding walls (5) of the homogenizing device (6) form a grid-like or net-like structure, or a honeycomb-like structure.

8. The jet former as claimed in claim 1, wherein the jet former (1) comprises a sanitary insertable component and is adapted to be detachably fitted into the water outlet (2) of an outlet fitting.

* * * * *